US012571149B2

(12) United States Patent
Scheckelhoff

(10) Patent No.: US 12,571,149 B2
(45) Date of Patent: Mar. 10, 2026

(54) HOUSEHOLD APPLIANCES WITH SMART STATUS INDICATORS

(71) Applicant: Haier US Appliance Solutions, Inc., Wilmington, DE (US)

(72) Inventor: Ryan James Scheckelhoff, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 198 days.

(21) Appl. No.: 18/183,119

(22) Filed: Mar. 13, 2023

(65) Prior Publication Data

US 2024/0309575 A1 Sep. 19, 2024

(51) Int. Cl.
*D06F 34/14* (2020.01)
*D06F 33/47* (2020.01)
(Continued)

(52) U.S. Cl.
CPC ..... *D06F 34/14* (2020.02); *D06F 33/47* (2020.02); *F25D 23/126* (2013.01);
(Continued)

(58) Field of Classification Search
CPC ..... D06F 33/37; D06F 33/47; D06F 33/57; D06F 33/74; D06F 34/14; D06F 39/02; D06F 39/022; D06F 2103/18; D06F 2103/22; D06F 2105/42; D06F 2105/58; F25D 23/126; F25D 29/008; F25D 2323/122; F25D 2331/806
See application file for complete search history.

(56) References Cited

U.S. PATENT DOCUMENTS 10,400,380 B2 9/2019 Lee
2017/0233931 A1* 8/2017 Lee ..... D06F 39/022 68/17 R
(Continued)

FOREIGN PATENT DOCUMENTS

EP 2591713 A2 5/2013
EP 3486362 B1 5/2022
(Continued)

OTHER PUBLICATIONS

Machine Translation of Hyundong et al., KR-20200120207-A, Oct. 2020. (Year: 2020).*

*Primary Examiner* — David G Cormier
(74) *Attorney, Agent, or Firm* — Dority & Manning, P.A.

(57) ABSTRACT

A method of operating a washing machine appliance includes checking for a material in a container of the household appliance. When the material is detected, the method may include recording a presence of the container in response to detecting the material in the container and deactivating a status indicator in response to detecting the material in the container. When the material is not detected, the method may include checking for the container in response to detecting the absence of the material. When the container is not detected, the method may include disabling a status indicator in response to detecting the absence of the container. When the container is detected, the method may include activating a status indicator in response to detecting the presence of the container and in response to detecting the absence of the material.

12 Claims, 10 Drawing Sheets

(51) Int. Cl.
*F25D 23/12* (2006.01)
*F25D 29/00* (2006.01)
*D06F 103/18* (2020.01)

(52) U.S. Cl.
CPC ..... *F25D 29/008* (2013.01); *D06F 2103/18* (2020.02); *F25D 2323/122* (2013.01)

(56) References Cited

U.S. PATENT DOCUMENTS

2019/0153653 A1* 5/2019 Clayton ..... G06F 3/04847
2020/0040511 A1* 2/2020 Scheckelhoff ..... D06F 33/42

FOREIGN PATENT DOCUMENTS

KR 20200062318 A 6/2020
KR 20200120207 A * 10/2020

* cited by examiner

HOUSEHOLD APPLIANCES WITH SMART STATUS INDICATORS

FIELD OF THE INVENTION

The present subject matter relates generally to household appliances, such as laundry appliances, e.g., washing machine appliances, refrigerator appliances, or other similar domestic appliances, and more particularly to systems and methods for monitoring feature status in such household appliances.

BACKGROUND OF THE INVENTION

Household appliances are utilized generally for a variety of tasks by a variety of users. For example, a household may include such appliances as laundry appliances, e.g., a washer and/or dryer, kitchen appliances, e.g., a refrigerator, a microwave, and/or a coffee maker, along with other various household appliances.

Some household appliances can also include features for storing and dispensing a material. For example, the material may be stored in a container such as a reservoir, tank, or other similar container. As one example, a refrigerator appliance may include features for dispensing ice, water, and/or other beverages. As another example, a laundry appliance may include features for dispensing detergent, fragrance, fabric softener, or other additives for treating articles in the laundry appliance.

Household appliances with such features for storing and dispensing the material generally are configured for monitoring the status of the feature, e.g., stored quantity of the material, and notifying or alerting a user based on certain status conditions, such as a low level or absence of the material. Monitoring of the feature may vary from one appliance to the next, for example, some models may include a sensor for checking the feature status, such as detecting a level of the material in the container, whereas other models may lack the sensor and models which lack the sensor may inaccurately alert the user that the container is empty. Additionally, some users may simply not make use of the feature, such that notifying or alerting the user based on certain status conditions is not desired.

As a result, it is desired in the art to provide improved status checks and status indicators, such as systems and methods for verifying the presence and/or utilization of household appliance features before providing status indicators related to such features.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method of operating a household appliance is provided. The method includes checking for a material in a container of the household appliance. The method further includes recording a presence of the container in response to detecting the material in the container of the household appliance and deactivating a status indicator in response to detecting the material in the container of the household appliance.

In another exemplary aspect of the present disclosure, a method of operating a household appliance is provided. The method includes checking for a material in a container of the household appliance. Checking for the material includes detecting an absence of the material in the container of the household appliance. The method also includes checking for the container in response to detecting the absence of the material in the container of the household appliance, and checking for the container comprises detecting an absence of the container. The method also includes disabling a status indicator in response to detecting the absence of the container.

In a further exemplary aspect of the present disclosure, a method of operating a household appliance is provided. The method includes checking for a material in a container of the household appliance, and checking for the material includes detecting the absence of the material in the container of the household appliance. The method also includes checking for presence of the container in response to detecting the absence of the material in the container of the household appliance. The method further includes activating a status indicator in response to detecting the presence of the container and in response to detecting the absence of the material in the container of the household appliance.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
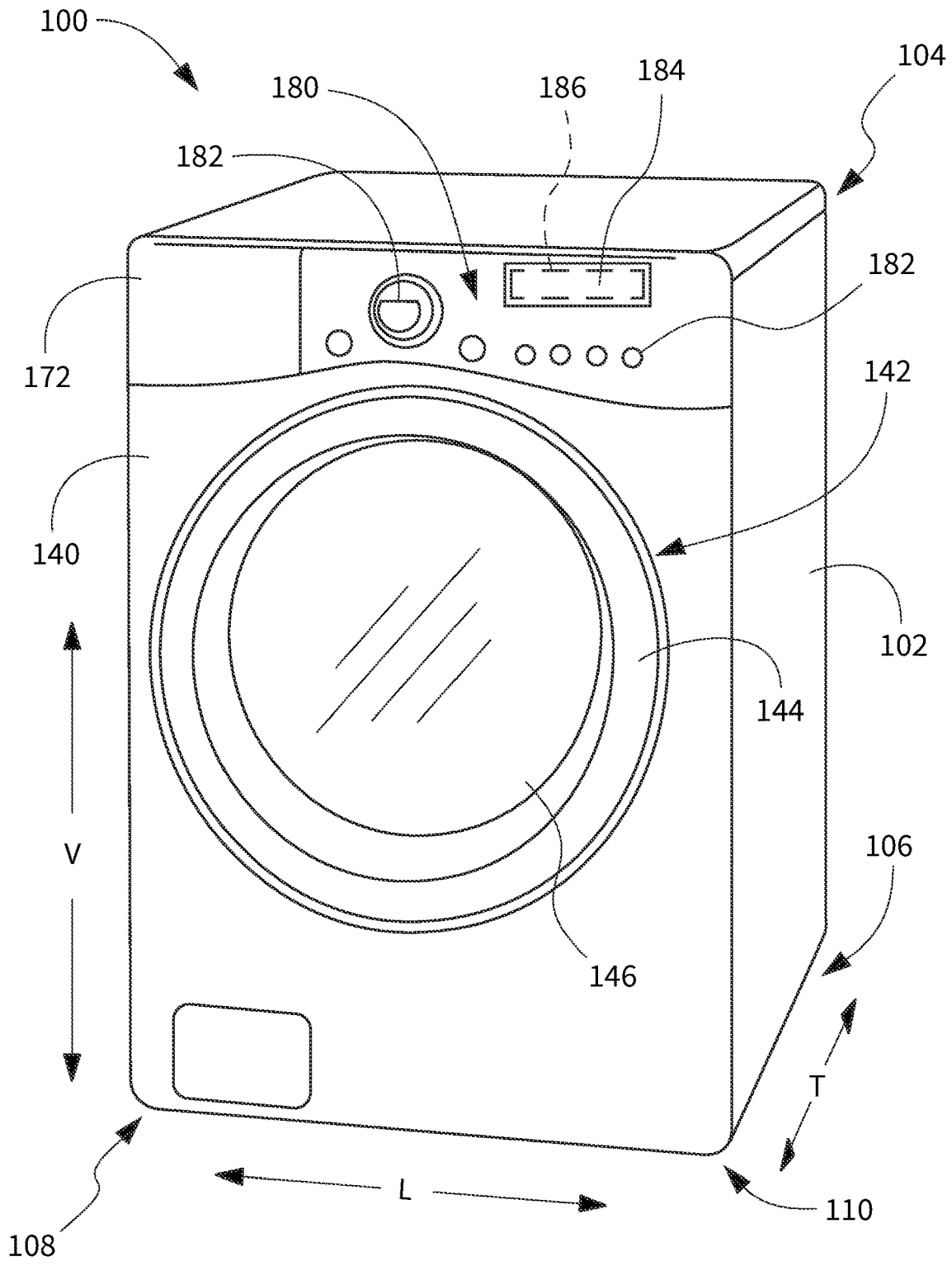
FIG. 1 provides a front perspective view of an exemplary washing machine appliance in accordance with one or more exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In order to aid understanding of this disclosure, several terms are defined below. The defined terms are understood to have meanings commonly recognized by persons of ordinary skill in the arts relevant to the present invention. The terms "includes" and "including" are intended to be inclusive in a manner similar to the term "comprising." Similarly, the term "or" is generally intended to be inclusive (i.e., "A or B" is intended to mean "A or B or both"). The terms "first," "second," and "third" may be used interchangeably to distinguish one element from another and are not intended to signify location or importance of the individual elements. Terms such as "inner" and "outer" refer to relative directions with respect to the interior and exterior of the washing machine appliance, and in particular the wash basket therein. For example, "inner" or "inward" refers to the direction towards the interior of the washing machine appliance. Terms such as "left," "right," "front," "back," "top," or "bottom" are used with reference to the perspective of a user accessing the washing machine appliance. For example, a user stands in front of the washing machine appliance to open the door and reaches into the wash basket to access items therein. Furthermore, it should be appreciated that as used herein, terms of approximation, such as "approximately," "generally," "substantially," or "about," refer to being within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counterclockwise.

Figure 2:
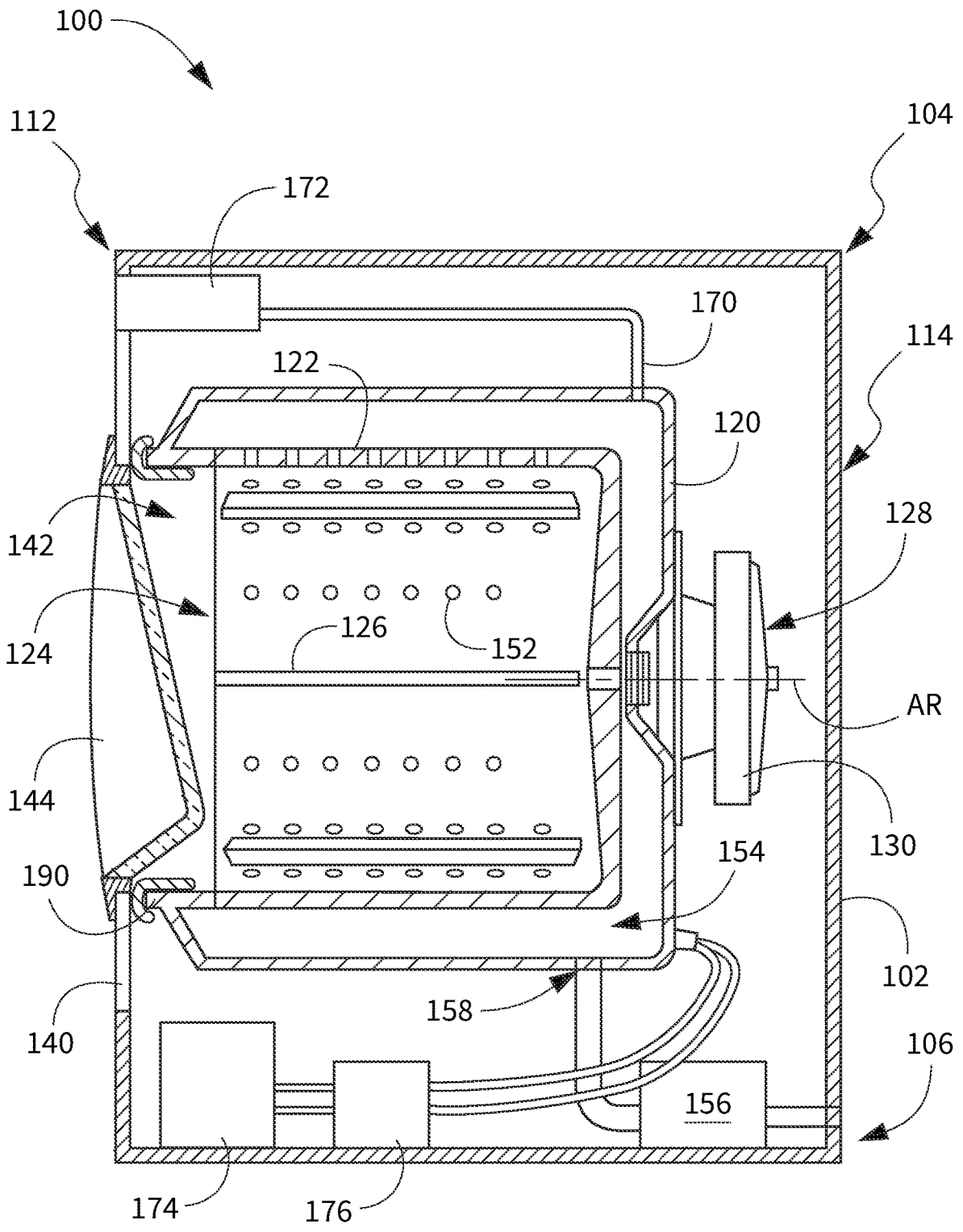
FIG. 2 provides a transverse cross-sectional view of the exemplary washing machine appliance of FIG. 1.

Referring now to the figures, FIG. 1 is a perspective view of an exemplary horizontal axis washing machine appliance 100 and FIG. 2 is a side cross-sectional view of washing machine appliance 100, which is an exemplary embodiment of a household appliance. As illustrated, washing machine appliance 100 generally defines a vertical direction V, a lateral direction L, and a transverse direction T, each of which is mutually perpendicular, such that an orthogonal coordinate system is generally defined. Washing machine appliance 100 includes a cabinet 102 that extends between a top 104 and a bottom 106 along the vertical direction V, between a left side 108 and a right side 110 along the lateral direction L, and between a front 112 and a rear 114 along the transverse direction T.

Referring to FIG. 2, a wash tub 120 is positioned within cabinet 102 and is generally configured for retaining wash fluids during an operating cycle. As used herein, "wash fluid" may refer to water, detergent, fabric softener, bleach, or any other suitable wash additive or combination thereof. A wash basket 122 is received within wash tub 120 and defines a wash chamber 124 that is configured for receipt of articles for washing. More specifically, wash basket 122 is rotatably mounted within wash tub 120 such that it is rotatable about an axis of rotation AR. According to the illustrated embodiment, the axis of rotation is substantially parallel to the transverse direction T. In this regard, washing machine appliance 100 is generally referred to as a "horizontal axis" or "front load" washing machine appliance 100. However, it should be appreciated that aspects of the present subject matter may be used within the context of a vertical axis or top load washing machine appliance as well.

Wash basket 122 may define one or more agitator features that extend into wash chamber 124 to assist in agitation and cleaning articles disposed within wash chamber 124 during operation of washing machine appliance 100. For example, as illustrated in FIG. 2, a plurality of ribs 126 extends from basket 122 into wash chamber 124. In this manner, for example, ribs 126 may lift articles disposed in wash basket 122 during rotation of wash basket 122.

Washing machine appliance 100 includes a drive assembly 128 which is coupled to wash tub 120 and is generally configured for rotating wash basket 122 during operation, e.g., such as during an agitation or spin cycle. More specifically, as best illustrated in FIG. 2, drive assembly 128 may include a motor assembly 130 that is in mechanical communication with wash basket 122 to selectively rotate wash basket 122 (e.g., during an agitation or a rinse cycle of washing machine appliance 100). According to the illustrated embodiment, motor assembly 130 is a pancake motor. However, it should be appreciated that any suitable type, size, or configuration of motors may be used to rotate wash basket 122 according to alternative embodiments. In addition, drive assembly 128 may include any other suitable number, types, and configurations of support bearings or drive mechanisms.

Referring generally to FIGS. 1 and 2, cabinet 102 also includes a front panel 140 that defines an opening 142 that permits user access to wash basket 122. More specifically, washing machine appliance 100 includes a door 144 that is positioned over opening 142 and is rotatably, e.g., pivotably, mounted to front panel 140 (e.g., about a door axis that is substantially parallel to the vertical direction V). In this manner, door 144 permits selective access to opening 142 by being movable between an open position (not shown) facilitating access to a wash tub 120 and a closed position (FIG. 1) prohibiting access to wash tub 120. For example, when the door 144 is in the closed position, the wash tub 120 may be enclosed by the door 144 and the cabinet 102. A gasket 190 may be provided in the opening 142 and the gasket 190 may sealingly engage the door 144 when the door 144 is in the closed position. For example, the gasket 190 may extend between the tub 120 and the front panel 140, e.g., generally along the transverse direction T and may extend about or around the opening 142 such that the gasket 190 is covered by the door 144 when the door 144 is in the closed position, and the gasket 190 may promote sealing between the door 144 and the cabinet 102, e.g., the front panel 140 of the cabinet 102.

In some embodiments, a window 146 in door 144 permits viewing of wash basket 122 when door 144 is in the closed position (e.g., during operation of washing machine appliance 100). Door 144 also includes a handle (not shown) that, for example, a user may pull when opening and closing door 144. Further, although door 144 is illustrated as mounted to front panel 140, it should be appreciated that door 144 may be mounted to another side of cabinet 102 or any other suitable support according to alternative embodiments.

Referring again to FIG. 2, wash basket 122 also defines a plurality of perforations 152 in order to facilitate fluid communication between an interior of basket 122 and wash tub 120. A sump 154 is defined by wash tub 120 at a bottom of wash tub 120 along the vertical direction V. Thus, sump 154 is configured for receipt of, and generally collects, wash fluid during operation of washing machine appliance 100. For example, during operation of washing machine appliance 100, wash fluid may be urged (e.g., by gravity) from basket 122 to sump 154 through the plurality of perforations 152. A pump assembly 156 is located beneath wash tub 120 for gravity assisted flow when draining wash tub 120 (e.g., via a drain 158). Pump assembly 156 is also configured for recirculating wash fluid within wash tub 120. Accordingly, pump assembly 156 may also be referred to or include a drain pump and/or a circulation pump.

Referring still to FIGS. 1 and 2, in some embodiments, washing machine appliance 100 may include an additive dispenser or spout 170. For example, spout 170 may be in fluid communication with a water supply (not shown) in order to direct fluid (e.g., clean water) into wash tub 120. Spout 170 may also be in fluid communication with the sump 154. For example, pump assembly 156 may direct wash fluid disposed in sump 154 to spout 170 in order to circulate wash fluid in wash tub 120.

As illustrated, a detergent drawer 172 may be slidably mounted within front panel 140. Detergent drawer 172 receives a wash additive (e.g., detergent, fabric softener, bleach, or any other suitable liquid or powder) and directs the fluid additive to wash chamber 124 during operation of washing machine appliance 100. According to the illustrated embodiment, detergent drawer 172 may also be fluidly coupled to spout 170 to facilitate the complete and accurate dispensing of wash additive.

In some embodiments, an optional bulk reservoir 174 may be disposed within cabinet 102. Bulk reservoir 174 may be configured for receipt of fluid additive for use during operation of washing machine appliance 100. Moreover, bulk reservoir 174 may be sized such that a volume of fluid additive sufficient for a plurality or multitude of wash cycles of washing machine appliance 100 (e.g., five, ten, twenty, fifty, or any other suitable number of wash cycles) may fill bulk reservoir 174. Thus, for example, a user can fill bulk reservoir 174 with fluid additive and operate washing machine appliance 100 for a plurality of wash cycles without refilling bulk reservoir 174 with fluid additive. A reservoir pump 176 may be configured for selective delivery of the fluid additive from bulk reservoir 174 to wash tub 120.

A control panel 180 including a plurality of input selectors 182 may be coupled to front panel 140. Control panel 180 and input selectors 182 collectively form a user interface input for operator selection of machine cycles and features. A display 184 of control panel 180 indicates selected features, operation mode, a countdown timer, and/or other items of interest to appliance users regarding operation.

Operation of washing machine appliance 100 is controlled by a processing device or a controller 186 that is operatively coupled to control panel 180 for user manipulation to select washing machine cycles and features. In response to user manipulation of control panel 180, controller 186 operates the various components of washing machine appliance 100 to execute selected machine cycles and features. Controller 186 may include a memory and microprocessor, such as a general or special purpose microprocessor operable to execute programming instructions or micro-control code associated with methods described herein. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 186 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 180 may be in communication with controller 186 via one or more signal lines or shared communication busses to provide signals to and/or receive signals from the controller 186.

In addition, the memory or memory devices of the controller 186 can store information and/or data accessible by the one or more processors, including instructions that can be executed by the one or more processors. It should be appreciated that the instructions can be software written in any suitable programming language or can be implemented in hardware. Additionally, or alternatively, the instructions can be executed logically and/or virtually using separate threads on one or more processors.

For example, controller 186 may be operable to execute programming instructions or micro-control code associated with an operating cycle of washing machine appliance 100. In this regard, the instructions may be software or any set of instructions that when executed by the processing device, cause the processing device to perform operations, such as running one or more software applications, displaying a user interface, receiving user input, processing user input, etc. Moreover, it should be noted that controller 186 as disclosed herein is capable of and may be operable to perform any methods, method steps, or portions of methods as disclosed herein. For example, in some embodiments, methods disclosed herein may be embodied in programming instructions stored in the memory and executed by controller 186.

The memory devices may also store data that can be retrieved, manipulated, created, or stored by the one or more processors or portions of controller 186. The data can include, for instance, data to facilitate performance of methods described herein. The data can be stored locally (e.g., on controller 186) in one or more databases and/or may be split up so that the data is stored in multiple locations. In addition, or alternatively, the one or more database(s) can be connected to controller 186 through any suitable network(s), such as through a high bandwidth local area network (LAN) or wide area network (WAN). In this regard, for example, controller 186 may further include a communication module or interface that may be used to communicate with one or more other component(s) of washing machine appliance 100, controller 186, an external appliance controller, or any other suitable device, e.g., via any suitable communication lines or network(s) and using any suitable communication protocol. The communication interface can include any suitable components for interfacing with one or more network(s), including for example, transmitters, receivers, ports, controllers, antennas, or other suitable components.

In exemplary embodiments, during operation of washing machine appliance 100, laundry items are loaded into wash basket 122 through opening 142, and a wash operation is initiated through operator manipulation of input selectors 182. For example, a wash cycle may be initiated such that wash tub 120 is filled with water, detergent, or other fluid additives (e.g., via detergent drawer 172 or bulk reservoir 174). One or more valves (not shown) can be controlled by washing machine appliance 100 to provide for filling wash basket 122 to the appropriate level for the amount of articles being washed or rinsed. By way of example, once wash basket 122 is properly filled with fluid, the contents of wash basket 122 can be agitated (e.g., with ribs 126) for an agitation phase of laundry items in wash basket 122. During the agitation phase, the basket 122 may be motivated about the axis of rotation AR at a set speed (e.g., first speed or tumble speed). As the basket 122 is rotated, articles within the basket 122 may be lifted and permitted to drop therein.

After the agitation phase of the washing operation is completed, wash tub 120 can be drained, e.g., by drain pump assembly 156. Laundry articles can then be rinsed (e.g., through a rinse cycle) by again adding fluid to wash tub 120, depending on the particulars of the cleaning cycle selected by a user. Ribs 126 may again provide agitation within wash basket 122. One or more spin cycles may also be used. In particular, a spin cycle may be applied after the wash cycle or after the rinse cycle in order to wring wash fluid from the articles being washed. During a spin cycle, basket 122 is rotated at relatively high speeds. For instance, basket 122 may be rotated at one set speed (e.g., second speed or pre-plaster speed) before being rotated at another set speed (e.g., third speed or plaster speed). As would be understood, the pre-plaster speed may be greater than the tumble speed and the plaster speed may be greater than the pre-plaster speed. Moreover, agitation or tumbling of articles may be reduced as basket 122 increases its rotational velocity such that the plaster speed maintains the articles at a generally fixed position relative to basket 122. After articles disposed in wash basket 122 are cleaned (or the washing operation otherwise ends), a user can remove the articles from wash basket 122 (e.g., by opening door 144 and reaching into wash basket 122 through opening 142).

During such operations, the gasket 190 may help to contain wash fluid within the cabinet 102, particularly within the tub 120. As generally shown in FIG. 2, the gasket 190 may be positioned between the door 144 and the tub 120, e.g., when the door 144 is in the closed position as in FIG. 2. Thus, the gasket 190 may sealingly engage the door 144 when the door 144 is in the closed position. In general, the gasket 190 sealingly engages the cabinet 102, in particular the opening 142 thereof, the tub 120, and the door 144. For example, the gasket 190 may extend around the opening 142 along a perimeter, e.g., circumference, of the opening 142 and may extend between the cabinet 102 and the wash tub 120 along a longitudinal axis, such as along or generally parallel to the transverse direction T.

It should be appreciated that the present subject matter is not limited to any particular style, model, or configuration of washing machine appliance. The exemplary embodiment depicted in FIGS. 1 and 2 is simply provided for illustrative purposes only. While described in the context of a specific embodiment of horizontal axis washing machine appliance 100, it will be understood that horizontal axis washing machine appliance 100 is provided by way of example only. Other washing machine appliances having different configurations, different appearances, and/or different features may also be utilized with the present subject matter as well. For example, different locations may be provided for the user interface, different configurations may be provided, e.g., vertical axis washing machines, and other differences may be applied as well.

Figure 3:
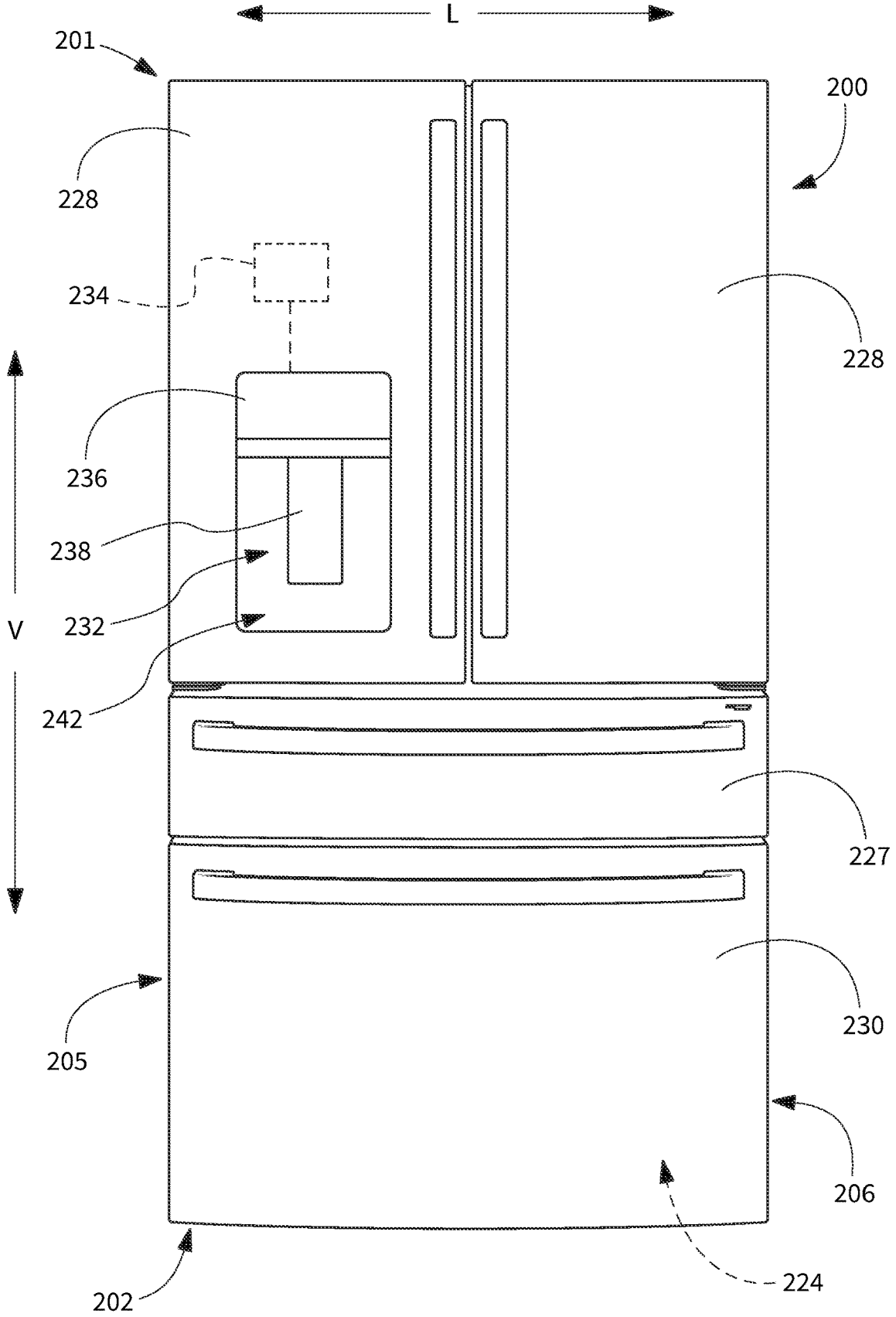
FIG. 3 provides a front view of a refrigerator appliance according to an exemplary embodiment of the present subject matter.
Figure 4:
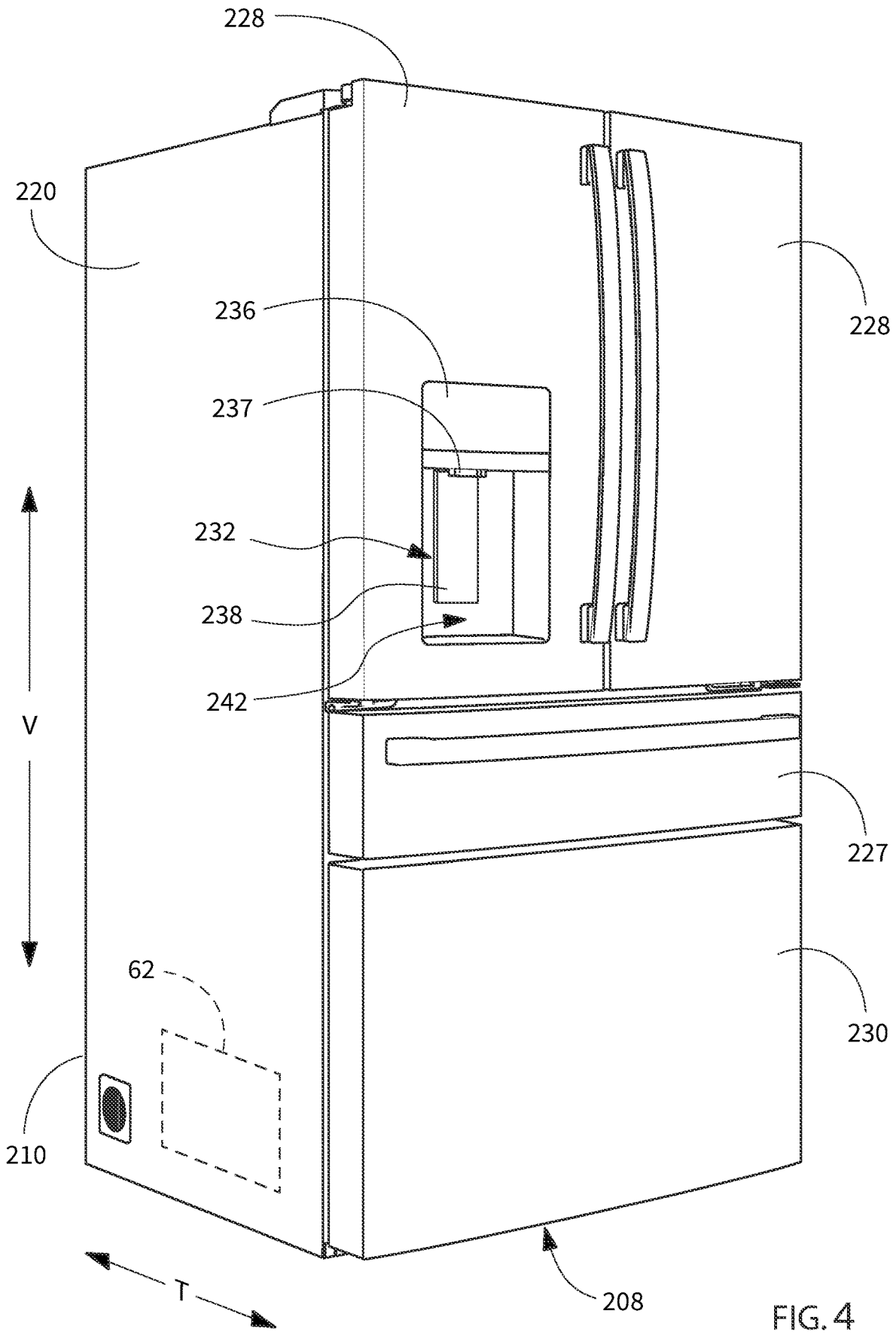
FIG. 4 provides a perspective view of the refrigerator appliance of FIG. 3.
Figure 5:
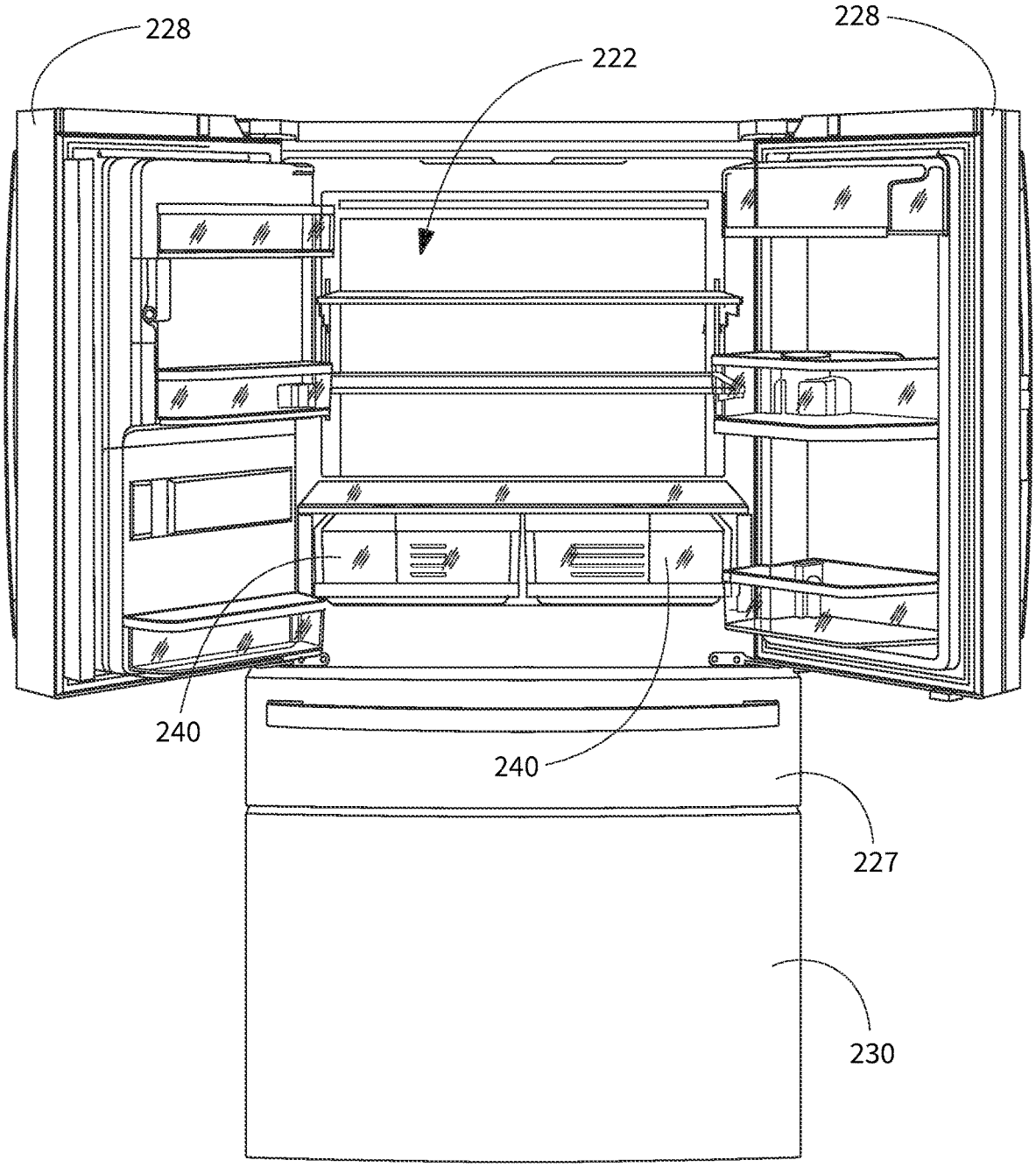
FIG. 5 provides a front view of the refrigerator appliance of FIG. 3 with doors in an open position.

FIG. 3 is a front view of an exemplary embodiment of a refrigerator appliance 200, which is another exemplary embodiment of a household appliance according to the present disclosure. FIG. 4 is a perspective view of the refrigerator appliance 200. FIG. 5 is a front view of the refrigerator appliance 200 with fresh food doors 228 thereof in an open position. Refrigerator appliance 200 extends between a top side 201 and a bottom side 202 along a vertical direction V. Refrigerator appliance 200 also extends between a first side 205 and a second side 206 along a lateral direction L which is perpendicular to the vertical direction V. As shown in FIG. 4, a transverse direction T may additionally be defined perpendicular to the vertical and lateral directions V. L. Refrigerator appliance 200 extends along the transverse direction T between a front side 208 and a back side 210.

Refrigerator appliance 200 includes a cabinet or housing 220 defining one or more chilled chambers, such as an upper fresh food chamber 222 (FIG. 5) and a lower freezer chamber or frozen food storage chamber 224 (FIG. 3) arranged below the fresh food chamber 222 along the vertical direction V. As used herein, the chambers may be "chilled" in that the chambers are operable at temperatures below room temperature, e.g., less than about seventy-five degrees Fahrenheit (75° F.). An auxiliary food storage chamber may be positioned between the fresh food storage chamber 222 and the frozen food storage chamber 224, e.g., along the vertical direction V. Because the frozen food storage chamber 224 is positioned below the fresh food storage chamber 222, refrigerator appliance 200 is generally referred to as a bottom mount refrigerator. In the exemplary embodiment, housing 220 also defines a mechanical compartment 62 (FIG. 4) for receipt of a sealed cooling system (not shown). Using the teachings disclosed herein, one of skill in the art will understand that the present technology can be used with other types of refrigerators (e.g., side-by-sides) or a freezer appliance as well. Consequently, the description set forth herein is for illustrative purposes only and is not intended to limit the technology in any aspect.

Refrigerator doors 228 are each rotatably hinged to an edge of housing 220 for accessing fresh food chamber 222. It should be noted that while two doors 228 in a "French door" configuration are illustrated, any suitable arrangement of doors utilizing one, two or more doors is within the scope and spirit of the present disclosure. A freezer door 230 is arranged below refrigerator doors 228 for accessing freezer chamber 224. In the exemplary embodiment, freezer door 230 is coupled to a freezer drawer (not shown) slidably mounted within freezer chamber 224. An auxiliary door 227 is coupled to an auxiliary drawer (not shown) which is slidably mounted within an auxiliary chamber (not shown). As may be seen in FIG. 5, a plurality of food storage compartments 240 are disposed within the fresh food storage chamber 222.

Operation of the refrigerator appliance 200 can be regulated by a controller 234 that is operatively coupled to a user interface panel 236. Interface panel 236 provides selections for user manipulation of the operation of refrigerator appliance 200 to modify environmental conditions therein, such as temperature selections, etc. In some embodiments, user interface panel 236 may be proximate a dispenser assembly 232. In response to user manipulation of the user interface panel 236, the controller 234 operates various components of the refrigerator appliance 200. Operation of the refrigerator appliance 200 can be regulated by the controller 234, e.g., controller 234 may regulate operation of various components of the refrigerator appliance 200 in response to programming and/or user manipulation of the user interface panel 236.

As best seen in FIGS. 3 and 4, dispensing assembly 232 includes a dispenser positioned on or mounted to an exterior portion of refrigerator appliance 200, e.g., on an outer surface of one of refrigerator doors 228. The dispenser includes a discharging outlet 237 (FIG. 4) for accessing ice and liquid water. An actuating mechanism 238, shown as a paddle, is mounted below discharging outlet 237 for operating the dispenser. In alternative exemplary embodiments, any suitable actuating mechanism may be used to operate the dispenser. For example, the dispensing assembly 232 can include a sensor (such as an ultrasonic sensor) or a button rather than the paddle 238. The user interface panel 236 may provide for controlling the mode of operation of the dispensing assembly 232. For example, user interface panel 236 includes a plurality of user inputs (not labeled), such as a water dispensing button and an ice-dispensing button, for selecting a desired mode of operation such as crushed or non-crushed ice. Additionally, the user inputs may include inputs for selecting one of a plurality of different liquids, such as juice, carbonated water or soda, tea, etc., and/or inputs for selecting a temperature for water to be dispensed, such as chilled, room temperature, or warm, among other possible options.

Discharging outlet 237 and actuating mechanism 238 are an external part of dispenser 232 and are mounted in a dispenser recess 242. Dispenser recess 242 is positioned at a predetermined elevation convenient for a user to access ice or liquids and enabling the user to access the dispensed ice and/or liquids without the need to bend-over and without the need to open refrigerator doors 228. In the exemplary embodiment, dispenser recess 242 is positioned at a level that approximates the chest level of an adult user. According to an exemplary embodiment, the dispensing assembly 232 may receive ice from an icemaker disposed in a sub-compartment of the fresh food chamber 222.

The controller 234 may include a memory and one or more microprocessors, CPUs or the like, such as general or special purpose microprocessors operable to execute programming instructions or micro-control code associated with operation of refrigerator appliance 200. The memory may represent random access memory such as DRAM, or read only memory such as ROM or FLASH. In one embodiment, the processor executes programming instructions stored in memory. The memory may be a separate component from the processor or may be included onboard within the processor. It should be noted that controllers 234 as disclosed herein are capable of and may be operable to perform any methods and associated method steps as may be disclosed herein.

The controller 234 may be positioned in a variety of locations throughout refrigerator appliance 200. In the illustrated embodiment, the controller 234 may be located within the door 228. In such an embodiment, input/output ("I/O") signals may be routed between the controller and various operational components of refrigerator appliance 100. In one embodiment, the user interface panel 236 may represent a general purpose I/O ("GPIO") device or functional block. In one embodiment, the user interface 236 may include input components, such as one or more of a variety of electrical, mechanical or electro-mechanical input devices including rotary dials, push buttons, and touch pads. The user interface 236 may include a display component, such as a digital or analog display device designed to provide operational feedback to a user. For example, the user interface 236 may include a touchscreen providing both input and display functionality. The user interface 236 may be in communication with the controller via one or more signal lines or shared communication busses.

Using the teachings disclosed herein, one of skill in the art will understand that the present subject matter can be used with other types of refrigerators such as a refrigerator/freezer combination, side-by-side, bottom mount, compact, and any other style or model of refrigerator appliance. Accordingly, other configurations of refrigerator appliance 200 could be provided, it being understood that the configurations shown in the accompanying figures and the description set forth herein are by way of example for illustrative purposes only.

The refrigerator appliance 200 may include a dispensing system, e.g., for dispensing one or more materials, such as ice, water, or multiple beverages. One example dispensing system for dispensing multiple fluids is illustrated schematically in FIG. 6. In various embodiments, the multiple fluids may be entirely distinct liquids, e.g., one or more juices, one or more flavored and/or carbonated waters, tea, e.g., iced tea, soda, etc., or may be the same liquid, such as water, at different temperatures, or may include any combination thereof, such as chilled water, room temperature water, and one or more juices. Additionally, in various embodiments, certain components of the multi-fluid dispensing system may be located in the cabinet 220 or in the door 228.

Figure 6:
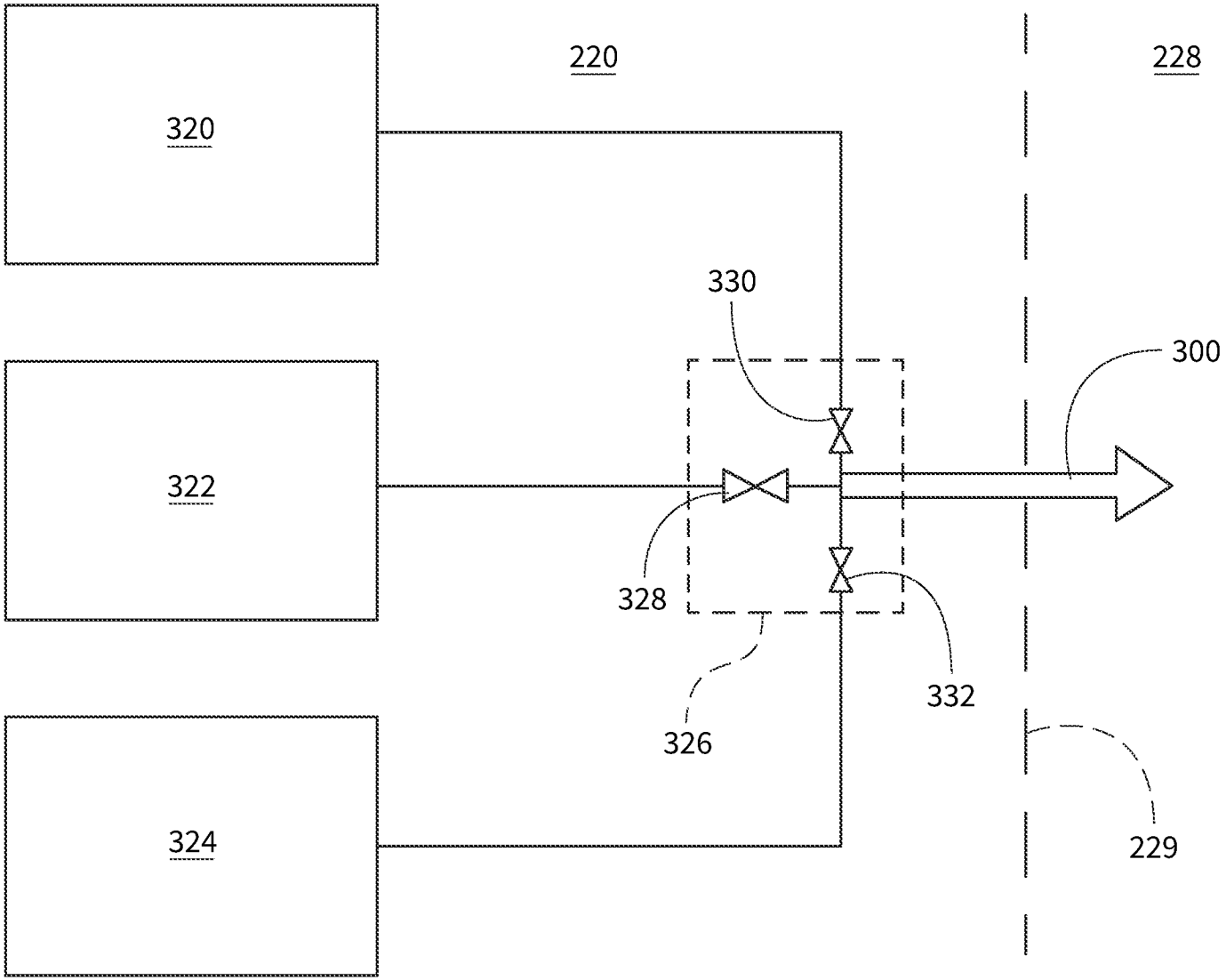
FIG. 6 provides a schematic illustration of a dispenser system for a refrigerator appliance according to one or more embodiments of the present subject matter.

In some embodiments, e.g., as illustrated in FIG. 6, the multi-fluid dispensing system may include a plurality of distinct liquid sources, such as a plurality of tanks or reservoirs where each tank may hold a distinct liquid which is separately and independently stored from the liquid in each other tank. For example, in the embodiment illustrated in FIG. 6, the multi-fluid dispensing system includes a first tank 320, a second tank 322, and a third tank 324, and each tank 320, 322, and 324 comprises a distinct liquid source, e.g., each tank contains a different liquid from that contained in every other tank. As mentioned above, the liquids may be one or more juices, tea, flavored water, etc.

Also as may be seen, e.g., in FIG. 6, the system may include a valve assembly 326. The valve assembly 326 generally includes a plurality of valves corresponding to the plurality of liquid sources, such as one valve for each liquid source and one liquid source coupled to each valve. For example, in embodiments such as the exemplary embodiment illustrated in FIG. 6, the plurality of liquid sources may include three liquid sources, e.g., three tanks 320, 322, and 324, and the valve assembly 326 may include three valves, with each valve coupled to a respective one of the tanks. In particular, as illustrated in FIG. 6, the valve assembly 326 may include a first valve 330 coupled between the first tank 320 and a multi-fluid tube 300, a second valve 328 coupled between the second tank 322 and the multi-fluid tube 300, and a third valve 332 coupled between the third tank 324 and the multi-fluid tube 300. Thus, in operation, opening the first valve 330 permits the first liquid from the first tank 320 to flow to the multi-fluid tube 300 (and from the multi-fluid tube 300 to the dispensing assembly 232), opening the second valve 328 permits the second liquid from the second tank 322 to flow to the multi-fluid tube 300 and thence to the dispensing assembly 232, etc. As schematically illustrated in FIG. 6, the refrigerator appliance 200 may include a cabinet 220 and a door 228, with the door 228 mounted, e.g., rotatably mounted, to the cabinet 220 by a hinge 229. In various embodiments, the multi-fluid tube 300 may pass through the hinge 229 to the dispensing assembly 232, as described above. Thus, the plurality of liquid sources, such as the three tanks 320, 322, and 324 illustrated in FIG. 6, may be located in the cabinet 220 and may be in fluid communication with the dispensing assembly 232 on the outer surface of the door 228 through the hinge 229 via the multi-fluid tube 300. In additional embodiments, the refrigerator appliance 200 may include more or less than three liquid sources, such as only one tank, e.g., for water, such as heated water for brewing tea or coffee, or another single liquid, or no liquid sources at all, such as the refrigerator may only store ice, e.g., in an ice bucket.

Figure 7:
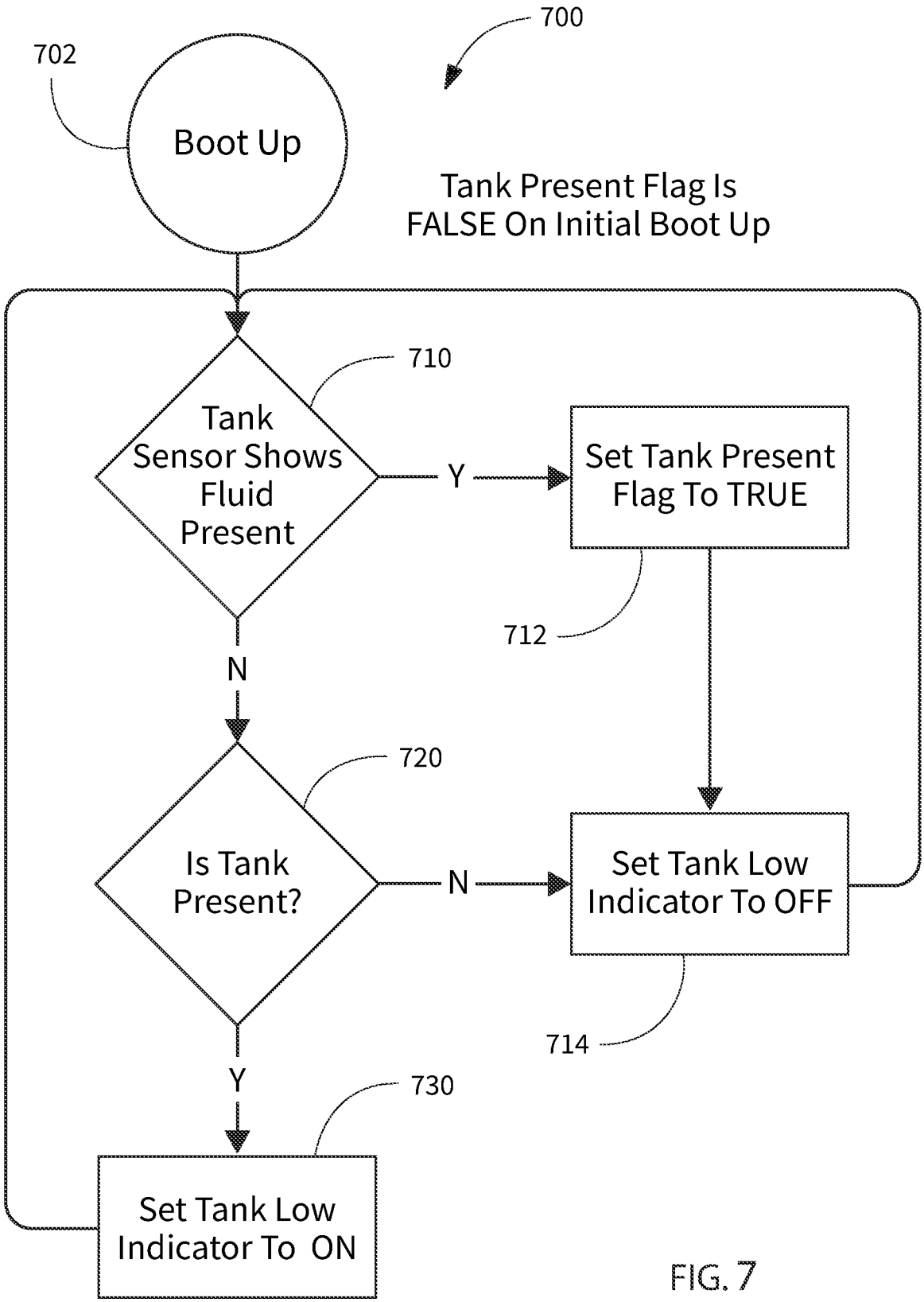
FIG. 7 provides a flow chart illustration of an exemplary method of operating a household appliance according to one or more exemplary embodiments of the present subject matter.

Embodiments of the present disclosure also include methods of operating a household appliance, such as the exemplary method 700 illustrated in FIG. 7. For example, the household appliance may be a laundry appliance, e.g., washing machine appliance 100 described above, or a refrigerator appliance, e.g., refrigerator appliance 200 described above. Additionally, a controller of the household appliance, such as controller 186 (of washing machine appliance 100) or controller 234 (of refrigerator appliance 200) may be operable to perform method 700 and/or any other methods and method steps described herein.

As illustrated in FIG. 7, in some embodiments, the method 700 may begin at boot up 702 of the household appliance. As noted in FIG. 7, the default condition is that a tank (or other container) for a material, e.g., fluid, is initially considered to not be present, e.g., a tank present flag is FALSE on initial boot up. When the tank present flag is FALSE, the status indicator, e.g., tank low indicator light, is not activated. Thus, methods according to the present disclosure assume the tank or other container is not present on the first time boot up of the appliance, and therefore the status indicator, e.g., "tank low" indicator, will not activate, e.g., light up, at first installation of the household appliance. For example, the status indicator will only activate after the container has been filled (which results in the tank present flag being changed, e.g., as discussed below with respect to step 712 of method 700) and then subsequently becomes empty. Method 700 may proceed after boot up 702 to a material check 710, wherein a determination is made whether a tank sensor shows that material, e.g., fluid, is present.

When the result of the material check 710 is positive, method 700 proceeds to setting the tank present flag to TRUE at 712, e.g., detecting the presence of material in the container (tank) is also used to confirm the presence of the container itself. Additionally, because the material in the container was detected a status indicator, such as a tank low indicator, may be deactivated, e.g., turned off, as indicated at 714 in FIG. 7.

When the result of the material check 710 is negative, method 700 continues with checking for the container itself, e.g., method 700 continues to determination 720 whether the tank is present. When the tank is present and an absence of the material (e.g., fluid) has already been detected by the negative result at 710, a status indicator, e.g., tank low indicator, may then be activated, e.g., turned on, such as at 730 in FIG. 7. When the determination 720 results in the tank not being present, the status indicator may be turned off, e.g., method 700 may continue to step 714 as illustrated in FIG. 7. Further, in at least some embodiments, when the tank is not present the status indicator may be disabled, e.g., may be permanently deactivated.

Figure 8:
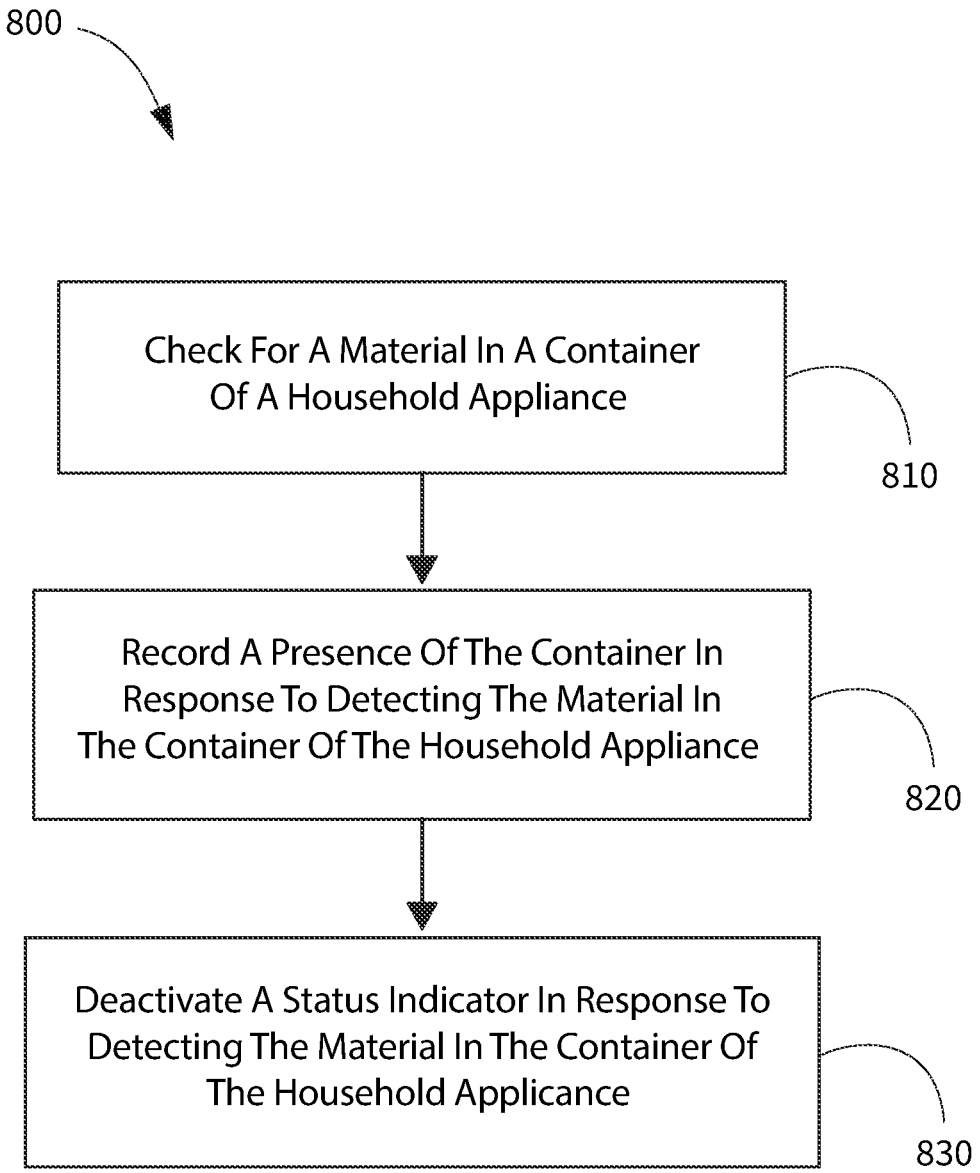
FIG. 8 provides a flow chart illustration of another exemplary method of operating a household appliance according to one or more exemplary embodiments of the present subject matter.

Another exemplary method 800 according to one or more embodiments of the present disclosure is illustrated in FIG. 8. As illustrated in FIG. 8, the method 800 may include a step 810 of checking for a material in a container of the household appliance. The material may be any suitable material, such as a liquid or powder, e.g., laundry detergent or dish detergent in liquid or powdered form, or any other suitable additive for treating articles in a dishwasher appliance or laundry appliance, or, as another example, the material may be dispensed from the appliance to a user, such as liquid water and/or ice, e.g., stored in and dispensed from a refrigerator appliance or ice maker appliance, etc. For example, the container may be a tank or reservoir which holds a quantity of the material in the household appliance, such as a quantity suitable for multiple operations, uses, etc., whereby the container may only be refilled periodically rather than refilled with each use. In some embodiments, the household appliance may include a sensor in the container, such as an optical sensor, a mechanical sensor such as a switch that is toggled when the material reaches a certain level within the container, an acoustic sensor, a pressure sensor, etc., and the sensor may be used to check for the material in the container.

Still referring to FIG. 8, the method 800 may also include a step 820 of recording a presence of the container in response to detecting the material in the container of the household appliance. For example, when the check at step 810 returns a positive result, e.g., when the material is detected or verified, the presence of the container is thus indirectly verified and may be recorded, e.g., at step 820. In some embodiments, recording the presence of the container may include setting a container present flag to true, e.g., where the container present flag is false prior to checking for the material in the container, such as the container present flag may be set to false as a default until the container presence is verified, e.g., thereby avoiding nuisance notifications such as tank low notifications when there is no tank.

Method 800 may further include a step 830 of deactivating a status indicator in response to detecting the material in the container of the household appliance. For example, where the status indicator is a tank low indicator, detecting the material in the container of the household appliance may indicate that the tank is sufficiently full for one or more future operations, cycles, dispensings, etc., of the material.

Figure 9:
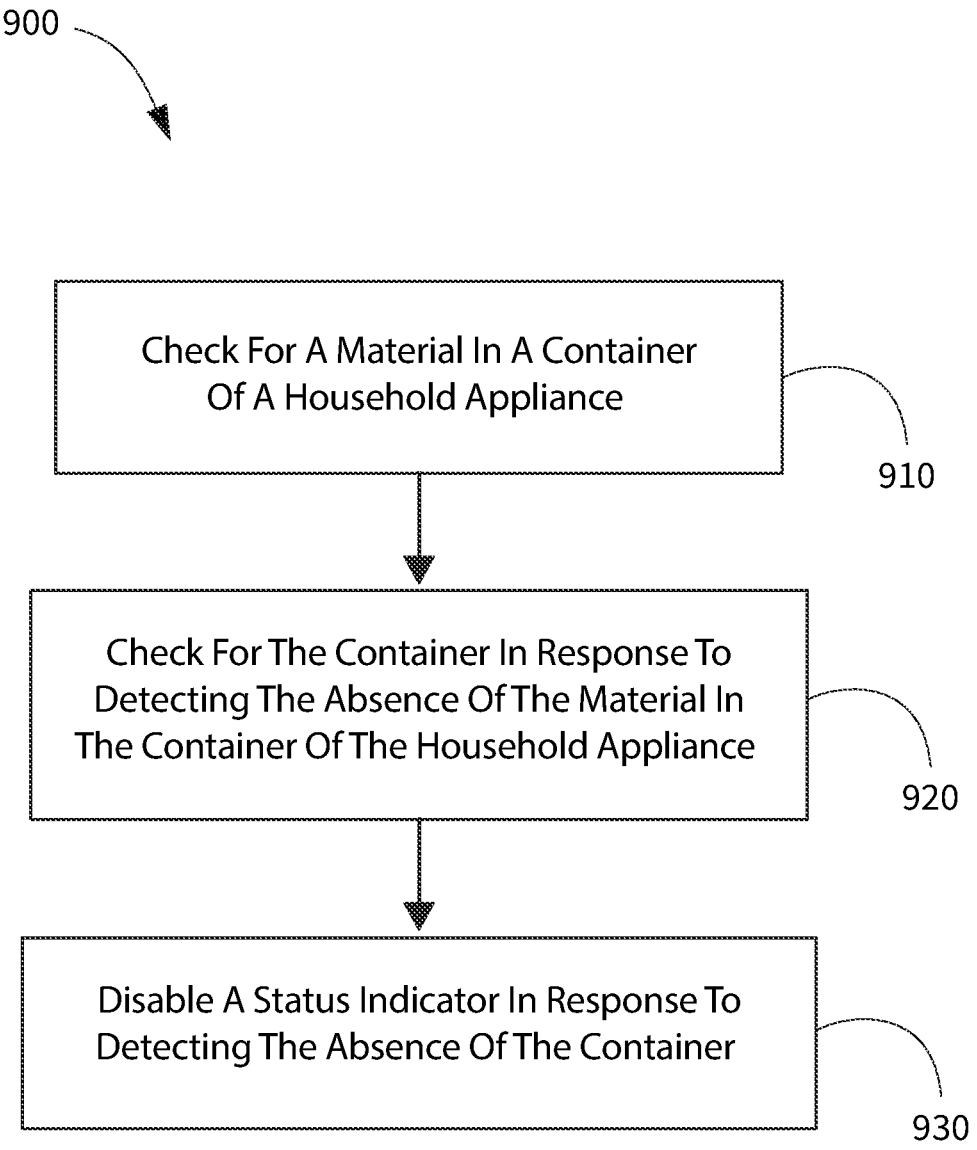
FIG. 9 provides a flow chart illustration of yet another exemplary method of operating a household appliance according to one or more exemplary embodiments of the present subject matter.

Another exemplary method 900 of operating a household appliance is illustrated in FIG. 9. As shown in FIG. 9, the method 900 may include a step 910 of checking for a material in a container of the household appliance. Checking for the material may include detecting an absence of the material in the container of the household appliance. For example, the household appliance may include a sensor, e.g., as mentioned above, and the absence of the material may be detected by the sensor. As another example, the household appliance may not include a sensor, and the absence of the material may be detected in that no signal from a tank sensor (or other sensor in, or in operative communication with, the container) is received. For example, the household appliance may be of a particular model which does not include the container and/or sensor.

Method 900 may further include a step 920 of checking for the container in response to detecting the absence of the material in the container of the household appliance, e.g., verifying whether the container itself is present but low or empty or whether the material was not present because there is no container for the material at all. Checking for the container may include detecting an absence of the container. Also as may be seen in FIG. 9, when the absence of the container itself is detected, the status indicator may be disabled, e.g., as shown at 930, in response. For example, disabling the status indicator may include permanently deactivating the status indicator such that no false warnings, e.g., no "tank low" indications for a tank that is not present, are given.

Figure 10:
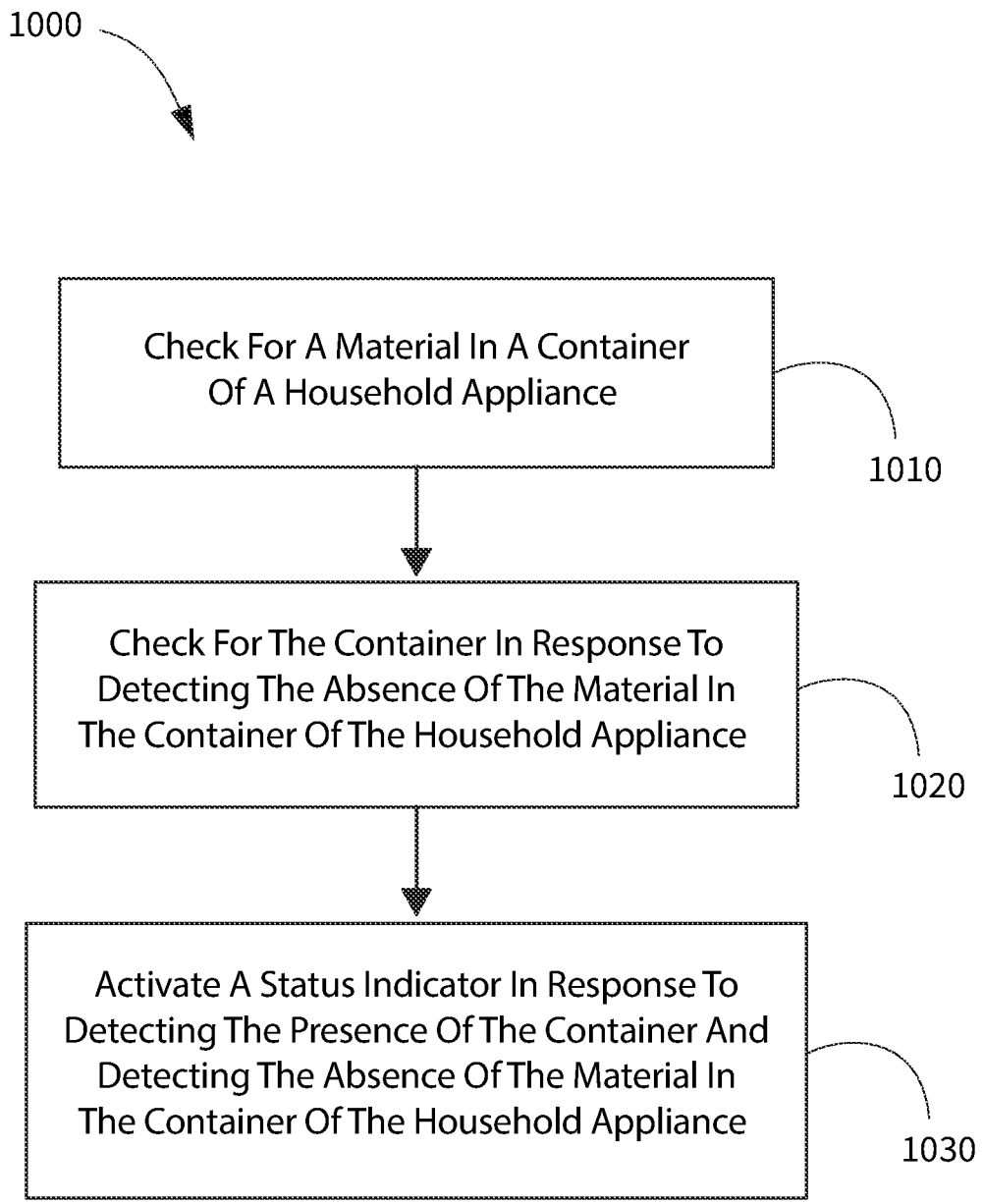
FIG. 10 provides a flow chart illustration of still another exemplary method of operating a household appliance according to one or more exemplary embodiments of the present subject matter.

Another exemplary method 1000 of operating a household appliance is illustrated in FIG. 10. The method 1000 may include a step 1010 of checking for a material in a container of the household appliance. Checking for the material may include detecting the absence of the material in the container of the household appliance. Method 1000 may also include a step 1020 of checking for presence of the container in response to detecting the absence of the material in the container of the household appliance. Method 1000 may further include a step 1030 of activating a status indicator. The status indicator may be activated in response to detecting the presence of the container and in response to detecting the absence of the material in the container of the household appliance, e.g., when the container is present but the material therein is not, the status indicator is activated. For example, the status indicator may be a tank low indicator.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a household appliance, the method comprising:

booting up the household appliance, wherein booting up the household appliance comprises an initial boot up of the household appliance, and wherein a container present flag is set to FALSE on the initial boot up;

checking for a material in a container of the household appliance;

recording a presence of the container in response to detecting the material in the container of the household appliance, wherein recording the presence of the container comprises setting the container present flag to TRUE; and deactivating a status indicator in response to detecting the material in the container of the household appliance.

2. The method of claim 1, wherein the household appliance is a laundry appliance.

3. The method of claim 1, wherein the household appliance is a refrigerator appliance.

4. The method of claim 1, wherein the material is an additive for treatment of articles and the container is a reservoir.

5. The method of claim 1, wherein the material is a beverage and the container is in fluid communication with a dispenser.

6. The method of claim 1, wherein the status indicator is a tank low indicator.

7. A method of operating a household appliance, the method comprising:

checking for a material in a container of the household appliance, wherein checking for the material comprises detecting an absence of the material in the container of the household appliance;

checking for the container in response to detecting the absence of the material in the container of the household appliance, wherein checking for the container comprises detecting an absence of the container; and disabling a status indicator in response to detecting the absence of the container, wherein the household appliance does not include a sensor, wherein detecting the absence of the material comprises receiving no signal from a sensor, and wherein detecting the absence of the container comprises receiving no signal from a sensor.

8. The method of claim 7, wherein the material is an additive for treatment of articles and the container is a reservoir.

9. The method of claim 7, wherein the material is a beverage and the container is in fluid communication with a dispenser.

10. The method of claim 7, wherein the household appliance is a laundry appliance.

11. The method of claim 7, wherein the household appliance is a refrigerator appliance.

12. The method of claim 7, wherein the status indicator is a tank low indicator.

* * * * *